US008640762B2

(12) United States Patent
Wong

(10) Patent No.: US 8,640,762 B2
(45) Date of Patent: Feb. 4, 2014

(54) BLIND SLAT CONTROLLER WITH BRAKING FUNCTION

(76) Inventor: Ming Lu Wong, Kaohsiung (TW)

( * ) Notice: Subject to any disclaimer, the term of this patent is extended or adjusted under 35 U.S.C. 154(b) by 365 days.

(21) Appl. No.: 13/271,138

(22) Filed: Oct. 11, 2011

(65) Prior Publication Data

US 2013/0087295 A1 Apr. 11, 2013

(51) Int. Cl.
*E06B 9/322* (2006.01)

(52) U.S. Cl.
USPC ..... 160/177 R; 160/307

(58) Field of Classification Search
USPC ..... 160/177 R, 307, 308, 176.1 R, 168.1 R, 160/170, 171, 323.1, 319, 321
See application file for complete search history.

(56) References Cited

U.S. PATENT DOCUMENTS 3,357,270 A * 12/1967 Spangenberg ..... 74/89.22
4,372,432 A * 2/1983 Waine et al. ..... 192/223.4
4,779,662 A * 10/1988 Wilk ..... 160/321
4,865,109 A * 9/1989 Sherman ..... 160/321
5,636,677 A * 6/1997 Liu ..... 160/177 R
5,680,892 A * 10/1997 Liu ..... 160/177 R
6,425,432 B1 * 7/2002 Gross et al. ..... 160/176.1 R
6,561,254 B1 * 5/2003 Liu ..... 160/177 R
6,601,636 B1 * 8/2003 Liu ..... 160/177 R
6,761,204 B1 * 7/2004 Chou ..... 160/177 R
7,562,600 B2 * 7/2009 Liu ..... 74/425
2007/0169900 A1 * 7/2007 Chen et al. ..... 160/321
2007/0251653 A1 * 11/2007 Liu ..... 160/177 R

* cited by examiner

*Primary Examiner* — David Purol
(74) *Attorney, Agent, or Firm* — Ming Chow; Sinorica, LLC

(57) ABSTRACT

A blind slat controller with braking function for rotating and locating blind slats at a certain light obstruction angle. The blind slat controller includes and a base seat and a cord reel having a protruding push body. The push body serves to push a coiled spring to unbind or bind a hub section of the base seat, whereby the cord reel is permitted to rotate or is braked and prevented from rotating. When unbound, a slat control rod can be driven and rotated to control the rotational angle of the blind slats. After the blind slats are rotated to a predetermined light obstruction angle, the cord reel stops rotating. At this time, due to the coiled spring's own elasticity, the coiled spring is restored to again bind the hub section. Accordingly, the cord reel is prevented from rotating to locate the blind slats at the predetermined light obstruction angle.

5 Claims, 10 Drawing Sheets

BLIND SLAT CONTROLLER WITH BRAKING FUNCTION

BACKGROUND OF THE INVENTION

1. Field of the Invention

The present invention relates to a blind slat controller with braking function for rotating and locating blind slats at a predetermined light obstruction angle.

2. Description of the Related Art

A conventional blind slat controller is used to turn open blind slats for light to come into a room or close the blind slats to obstruct the light. The conventional blind slat controller generally includes a cord reel and two pull cords affixed to the cord reel. The pull cords can be pulled up and down to rotate the cord reel for driving and rotating a control shaft. The control shaft then controls the blind slats to rotate to a desired light obstruction angle.

U.S. Pat. Nos. 7,562,600m 6,761,204, 6,601,636, 6,561,254 and 5,636,677 disclose some typical blind slat controllers. The typical blind slat controller generally includes a cord reel and two pull cords wound on the cord reel. The pull cords can be pulled up and down to rotate the cord reel for driving and rotating a shaft rod. The shaft rod in turn drives a control shaft to control the blind slats to rotate to a desired light obstruction angle. The shaft rod is drivingly connected with the control shaft via a thread engagement transmission. There are gaps between the threads and the blind slat controller has no brake structure. Therefore, when the blind slats reach a predetermined light obstruction angle and a user stops pulling the pull cords to stop the cord reel from rotating, the weight of the blind slats will cause a downward pull force. Under the downward pull force, the control shaft is displaced in a reverse direction. In this case, there will be an error in light obstruction angle and the blind slats can be hardly located at the true light obstruction angle. Therefore, the blind equipped with the conventional blind slat controller has poorer light obstruction effect and cannot be accurately operated.

Moreover, the pull cords wound around the cord reel are generally directly suspended from the blind rail and positioned under the window. In this case, a child is likely to play the pull cords and get strangled. This is quite dangerous and leads to poor appearance.

SUMMARY OF THE INVENTION

It is therefore a primary object of the present invention to provide a blind slat controller with braking function. The blind slat controller is able to effectively locate blind slats at a predetermined light obstruction angle. At least one coiled spring is fitted on a base seat. A cord reel is used to control the coiled spring to unbind or bind the base seat. When unbound, the cord reel can be rotated to adjust the angle of the blind slats. When bound, the cord reel is braked and prevented from rotating to locate the blind slats at the predetermined light obstruction angle. This overcomes the problems existing in the conventional blind slat controller that the blind slats cannot be truly located and the operation cannot be accurately performed.

It is a further object of the present invention to provide the above blind slat controller, which is able to prevent a child from playing the pull cord and thus protect the child from being strangled by the pull cord.

To achieve the above and other objects, the blind slat controller with braking function of the present invention includes a base seat receivable in a blind rail and having a hub section formed on one side of the base seat, a shaft rod received in the base seat, a worm gear engaged with the shaft rod, a cord reel connected with one end of the shaft rod and a coiled spring fitted on the hub section of the base seat and positioned in the cord reel. The cord reel has a protruding push body. When rotating the cord reel, the push body serves to push a coiled spring to unbind or bind a hub section of the base seat, whereby the cord reel is permitted to rotate or is braked and prevented from rotating. When unbound, a slat control rod can be driven and rotated to control the rotational angle of the blind slats. After the blind slats are rotated to a predetermined light obstruction angle, the cord reel stops rotating. At this time, due to the coiled spring's own elasticity, the coiled spring is restored to again bind the hub section. The bent up stop section of coiled spring serves to stop the cord reel from rotating backward so as to prevent the blind slats from moving downward. Accordingly, the blind slats can be located in their true positions without error in light obstruction angle.

After wound around the cord reel, two ends of the pull cord are conducted out of the blind rail to fixedly connect with a hard pull cord member for ensuring safety. The pull cord member includes a movable sleeve having a hollow interior and an elongated straight rod fitted through the hollow interior of the movable sleeve. Two ends of the pull cord are respectively connected with the movable sleeve and the elongated straight rod. The two ends of the pull cord can be one up and one down pulled by means of operating the movable sleeve or the elongated straight rod to directly control the rotation of the cord reel so as to control and locate the blind slats. The hard structure of the pull cord member prevents a child from playing the pull cord and thus protects the child from being strangled by the pull cord.

The present invention can be best understood through the following description and accompanying drawings, wherein:

DETAILED DESCRIPTION OF THE PREFERRED EMBODIMENTS

Figure 1:
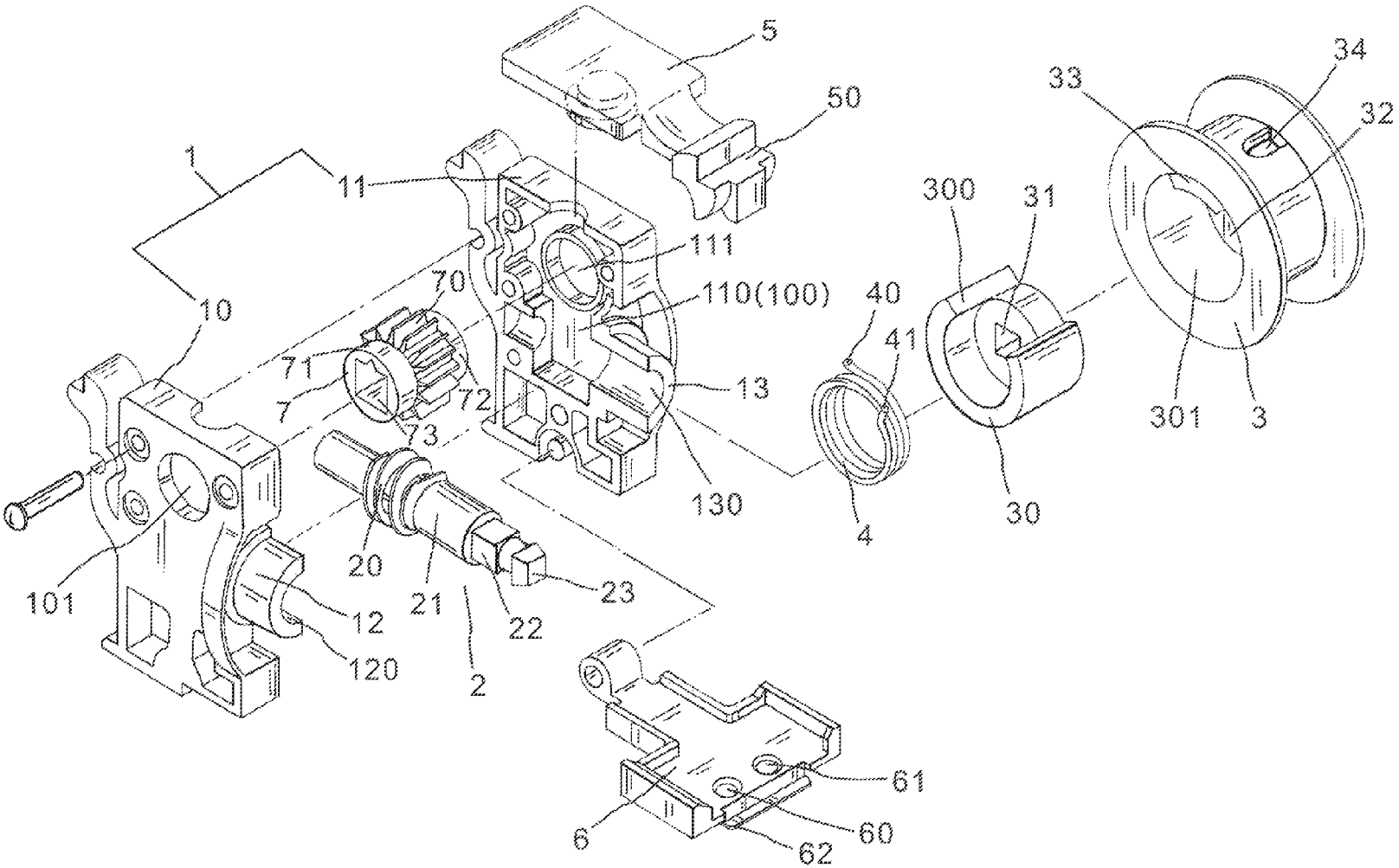
FIG. 1 is a perspective exploded view of the present invention.

Please refer to FIGS. 1 to 4. The blind slat controller with braking function of the present invention includes a base seat 1, a shaft rod 2 received in the base seat 1, a cord reel 3 on which a pull cord is fixedly disposed and wound, a coiled spring 4 fitted on one side of the base seat 10 and received in the cord reel 3, a movable engagement body 5 and a movable cover board 6. The base seat 1 is composed of a first casing 10 and a second casing 11, which are mated and assembled with each other to form the base seat 1. The movable engagement body 5 and the movable cover board 6 are respectively horizontally rotatably mounted at upper and lower ends of the base seat 1.

Each of the first and second casings 10, 11 is formed with a cavity 100, 110. A semi-tubular protrusion 12, 13 extends from one side of the cavity 100, 110 to define a semicircular trough 120, 130 in communication with the cavity 100, 110. The first and second casings 10, 11 are mated and assembled with each other, whereby the semi-tubular protrusions 12, 13 together form a cylindrical hub section with a central circular hole on one side of the base seat 1. The coiled spring 4 is fitted around the hub section. Two ends of the coiled spring 4 are respectively formed with two bent up stop sections 40, 41. An inner face of each cavity 100, 110 is correspondingly formed with a perforation 101, 111. Two lateral barrel sections 71, 72 of a worm gear are fitted in the perforations 101, 111 respectively, whereby the worm gear 7 is rotatably mounted in the base seat 1. The worm gear 7 has a tooth section 70 engaged with the thread 20 of the shaft rod 2. When the shaft rod 2 is rotated, the worm gear 7 is driven by the shaft rod 2 to rotate. The worm gear 7 is formed with an axial rectangular shaft hole 73. A blind slat control rod is fitted in the shaft hole 73, whereby the blind slat control rod can be driven to rotate the blind slats by different light obstruction angles.

The shaft rod 2 is received in the base seat 1, including a circular rod section 21 with the thread 20 and a rectangular rod section 22. The circular rod section 21 is received in the semicircular troughs 120, 130 of the first and second casings 10, 11, whereby the shaft rod 2 is rotatably restricted within the base seat 1. The rectangular rod section 22 protrudes out of the semicircular troughs 120, 130. A connection body 30 is formed with a rectangular hole 31 corresponding to the rectangular rod section 22. The rectangular rod section 22 is fitted in the rectangular hole 31 to connect with the connection body 30. A front end of the rectangular rod section 22 is formed with an insertion block 23. The insertion block 23 abuts against a closed face 32 of the cord reel 3 to integrally fixedly connect the shaft rod 2 with the cord reel 3. The cord reel 3 is fitted around the cylindrical hub section of the base seat 1 with the connection body 30 received in an open end 301 of the cord reel 3. An upper side of the connection body 30 is formed with a notch 300. A push body 33 protrudes from inner circumference of the open end of the cord reel 3. The notch 300 provides a space for the push body 33 to extend into, whereby the push body 33 can push and twist/untwist the coiled spring 4 so as to unbind or bind the hub section of the base seat 1.

Figure 2:
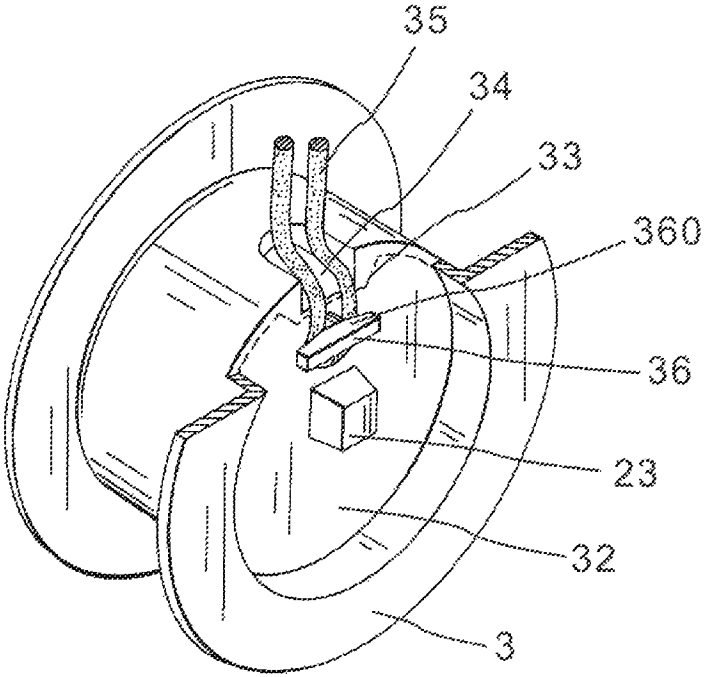
FIG. 2 is a partially sectional view of the cord reel of the present invention.
Figure 3:
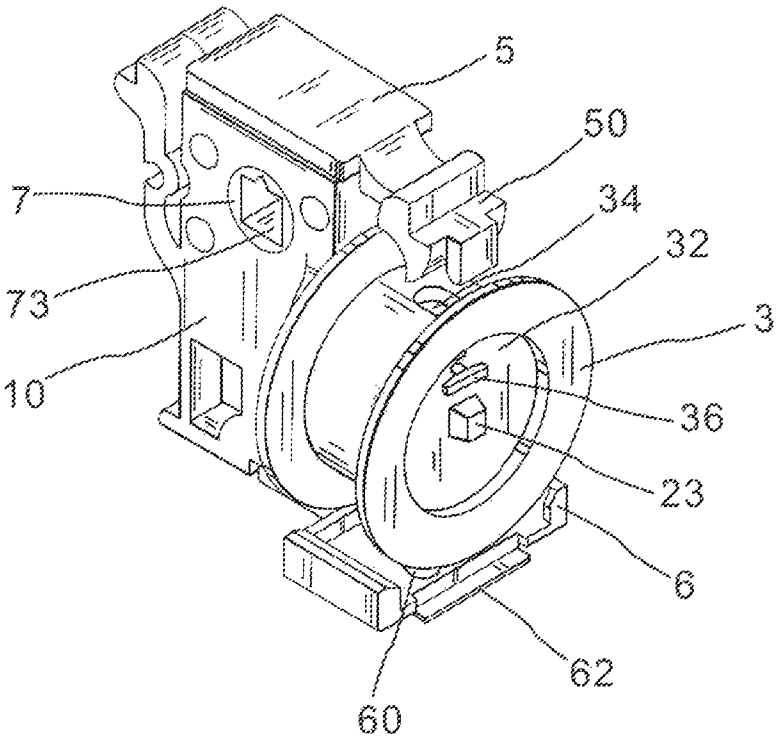
FIG. 3 is a perspective assembled view of the present invention.
Figure 4:
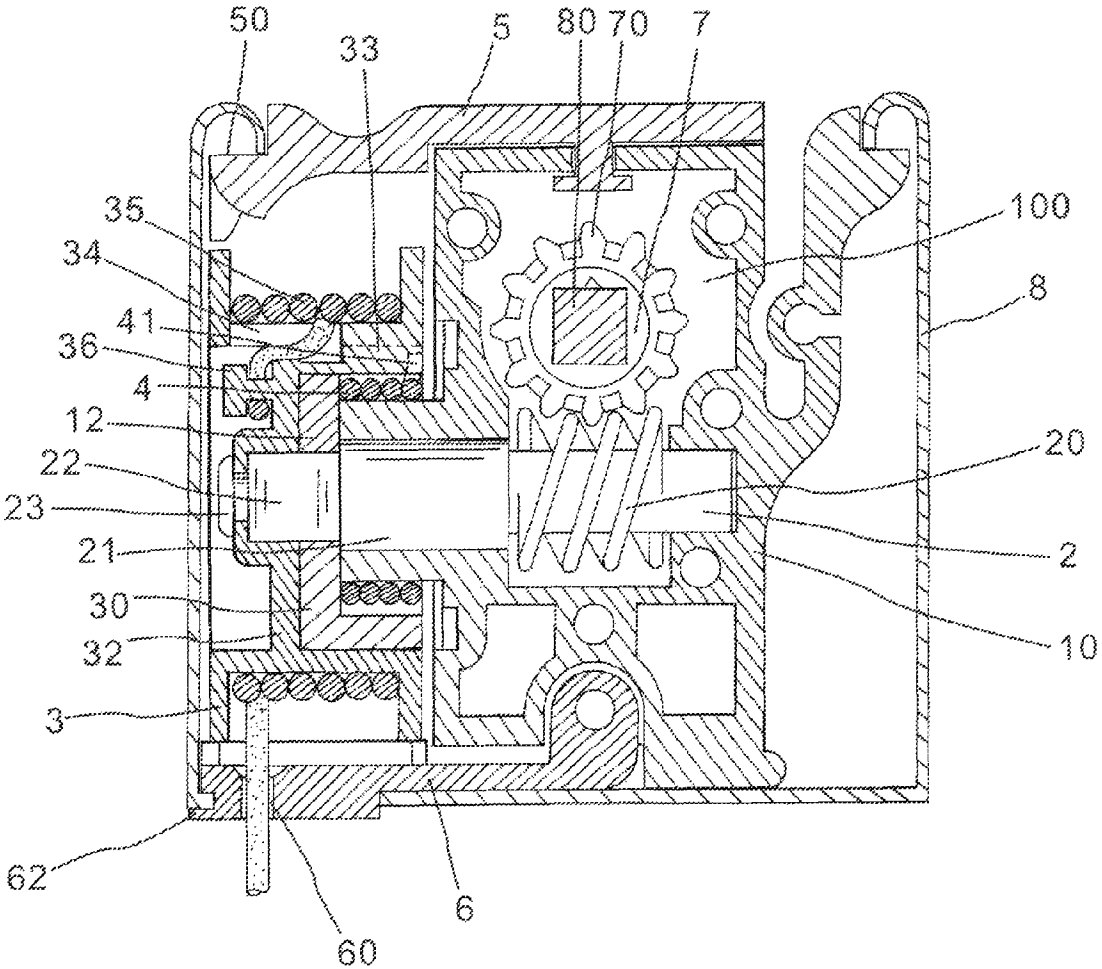
FIG. 4 is a sectional assembled view of the present invention.

The rotation of the cord reel 3 is controlled by a pull cord 35. Referring to FIG. 2, the pull cord 35 is conducted in such a manner that the pull cord 35 is looped and conducted in through a cord hole 34 formed on drum body of the cord reel 3. The pull cord 35 is then conducted out of the closed face 32 of the cord reel 3 to be wound over a cord retainer bar 36 on the closed face 32. The cord retainer bar 36 is substantially T-shaped and has an oblique inner face 360 for fastening the pull cord 35. Two ends of the pull cord 35 are wound around the drum body of the cord reel 3 and respectively conducted through two through holes 60, 61 of the movable cover board 6. Accordingly, the rotation of the cord reel 3 can be controlled by means of pulling the pull cord 35 (as shown in FIG. 4).

Figure 5:
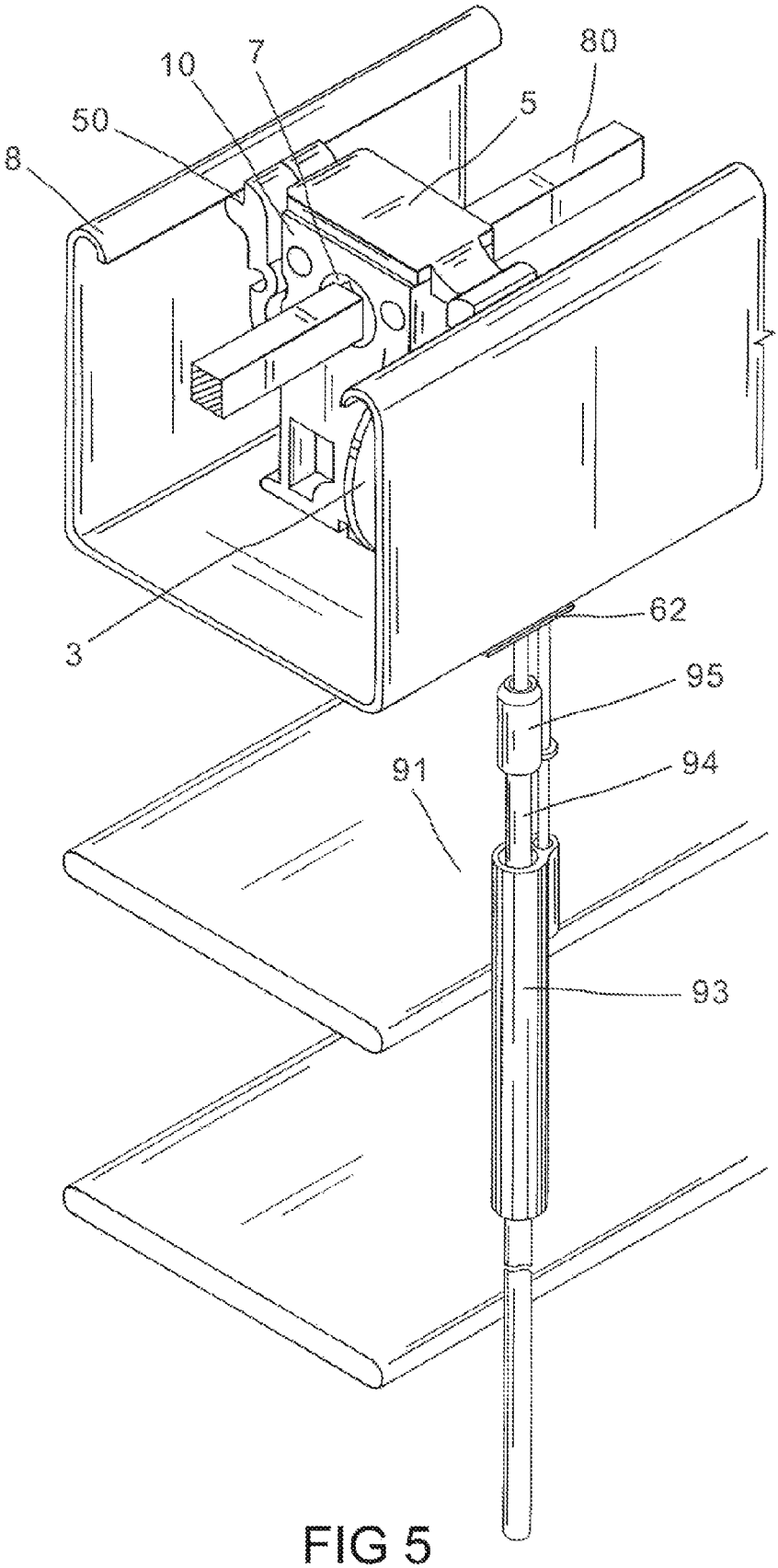
FIG. 5 is a perspective view showing the installation of the present invention.
Figure 6:
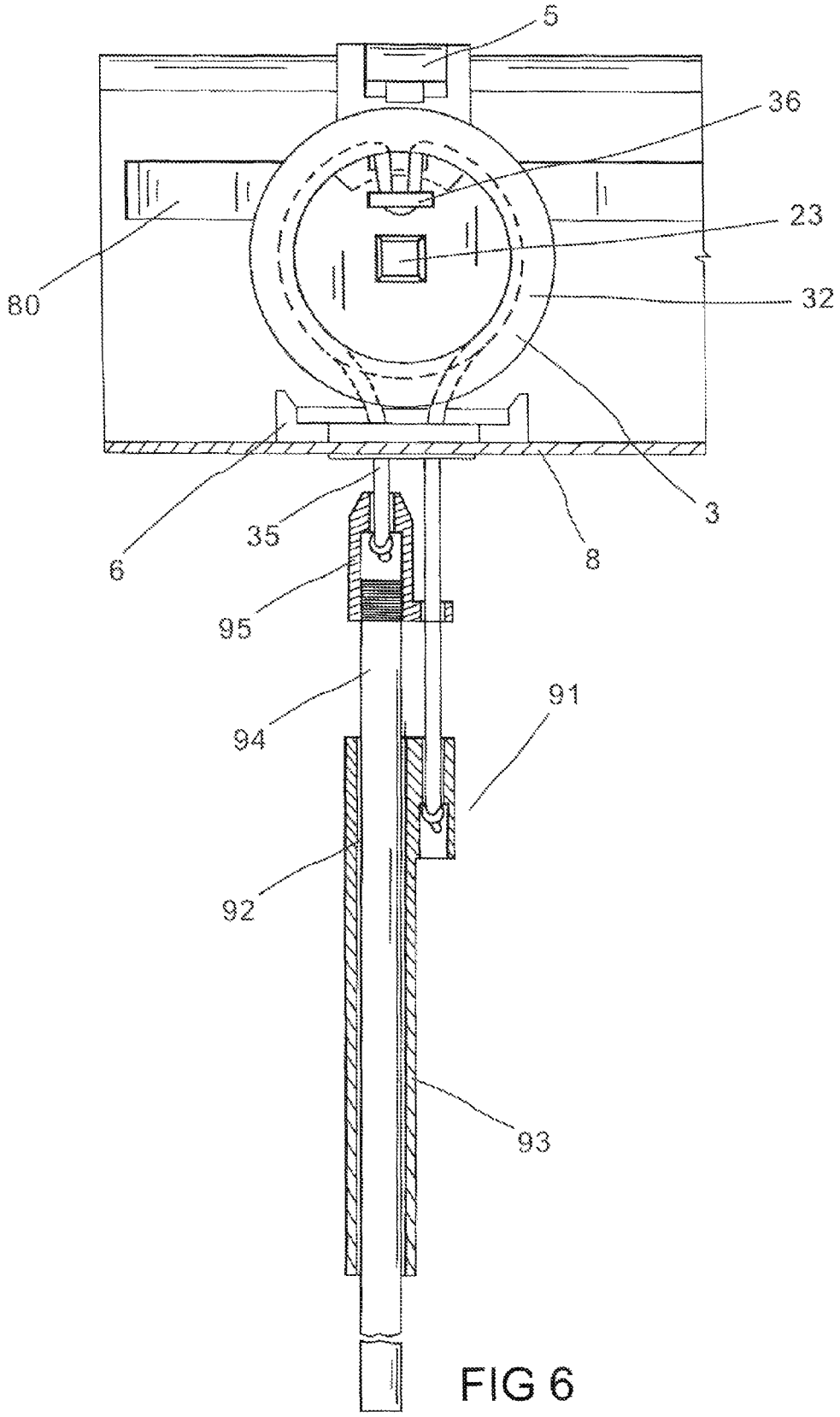
FIG. 6 is a perspective assembled view of the present invention, showing the pull cord member thereof.
Figure 7:
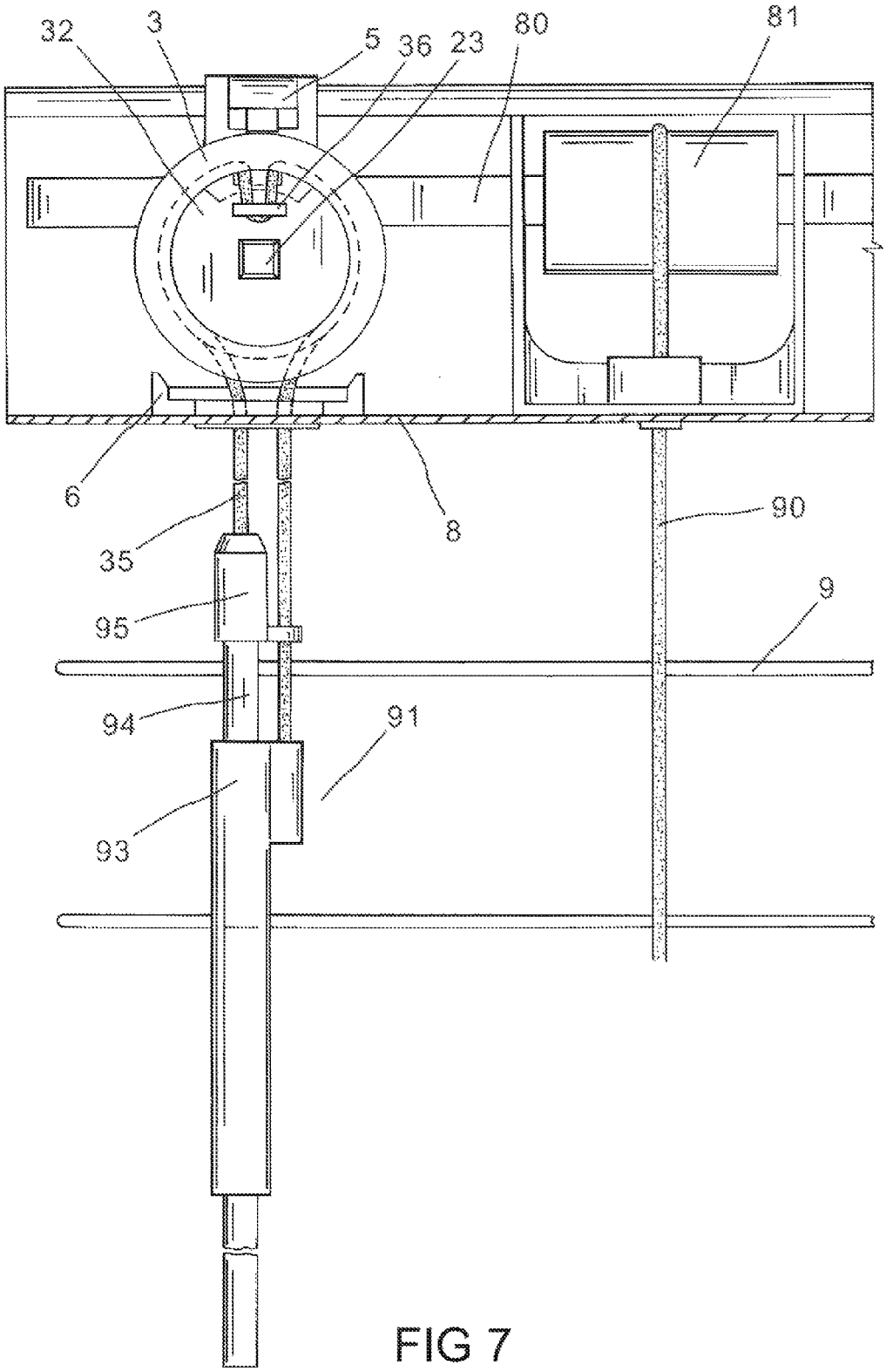
FIG. 7 is a view showing that the present invention is assembled with the control drum.

FIG. 5 shows the installation of the controller of the present invention. The movable engagement body 5 has an engagement channel 50. The movable engagement body 5 is disposed at the upper end of the base seat 1 and can be horizontally transversely swung to engage the engagement channel 50 with an upper edge of a blind rail 8. The movable cover board 6 has a flap 62 on lower side. The flap 62 is inlaid in the bottom of the blind rail 8 to affix the base seat 1 in the blind rail 8 (as shown in FIGS. 4 and 5). The ends of the pull cord 35, which are conducted out of the perforations 60, 61 of the movable cover board 6, are fixedly connected with a hard pull cord member 91 for ensuring safety (as shown in FIGS. 5 and 6). The pull cord member 91 includes a movable sleeve 93 having a hollow interior 92, an elongated straight rod 94 fitted through the hollow interior 92 of the movable sleeve 93 and a connection piece 95 affixed to top end of the elongated straight rod 94 and connected with one end of the pull cord. The movable sleeve 93 is fixedly connected with the other end of the pull cord. The movable sleeve 93 is restricted to slide along the elongated straight rod 94 only. The two ends of the pull cord can be one up and one down pulled by means of operating the movable sleeve 93 or the elongated straight rod 94 to directly control the rotation of the cord reel 3 so as to control and locate the blind slats. The hard structure of the pull cord member 91 prevents a child from playing the pull cord 35 and thus protects the child from being strangled by the pull cord 35. In a conventional driving manner, the slat control rod 80 is fitted in the rectangular shaft hole 73 of the worm gear 7 and axially extends to a control drum 81 (as shown in FIG. 7). The slat control rod 80 applies a rotational force to the control drum 81 to synchronously drive the ladder cord 90 of the blind slats 9 up and down, whereby the blind slats 9 can be rotated by different light obstruction angles.

Figure 8:
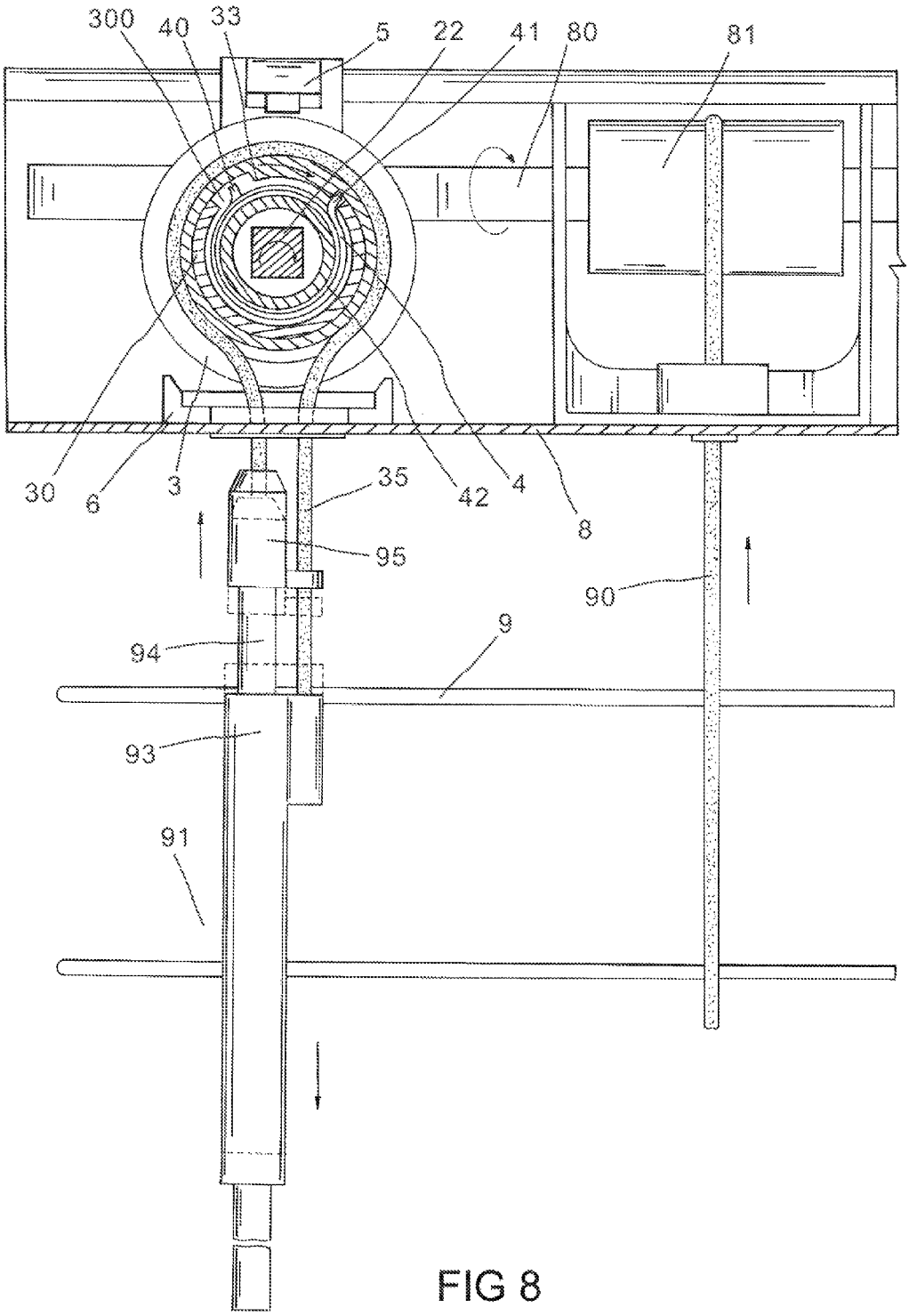
FIG. 8 is a view showing the operation of the present invention.
Figure 9:
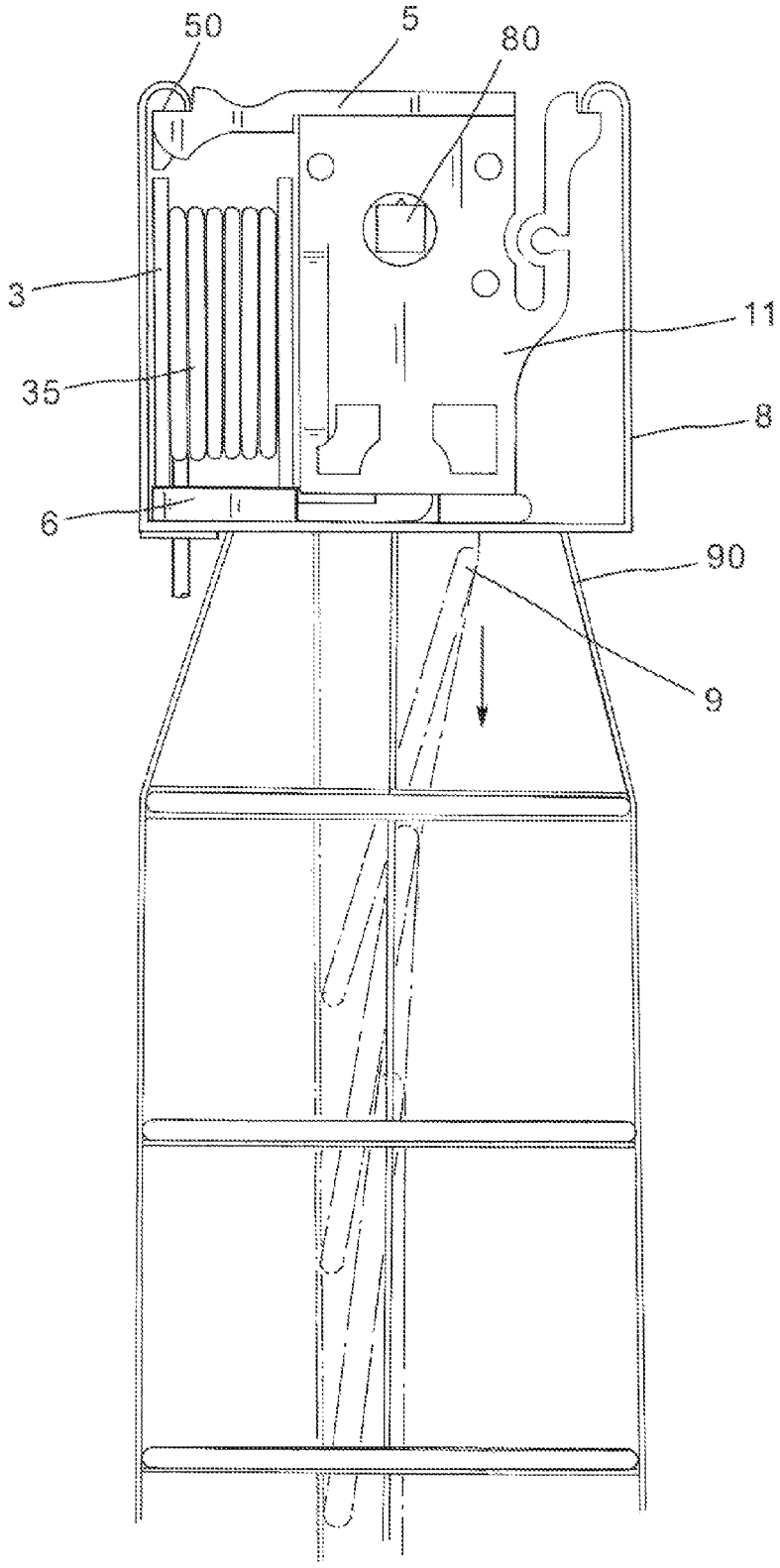
FIG. 9 is a view showing that the blind slats are pulled downward.
Figure 10:
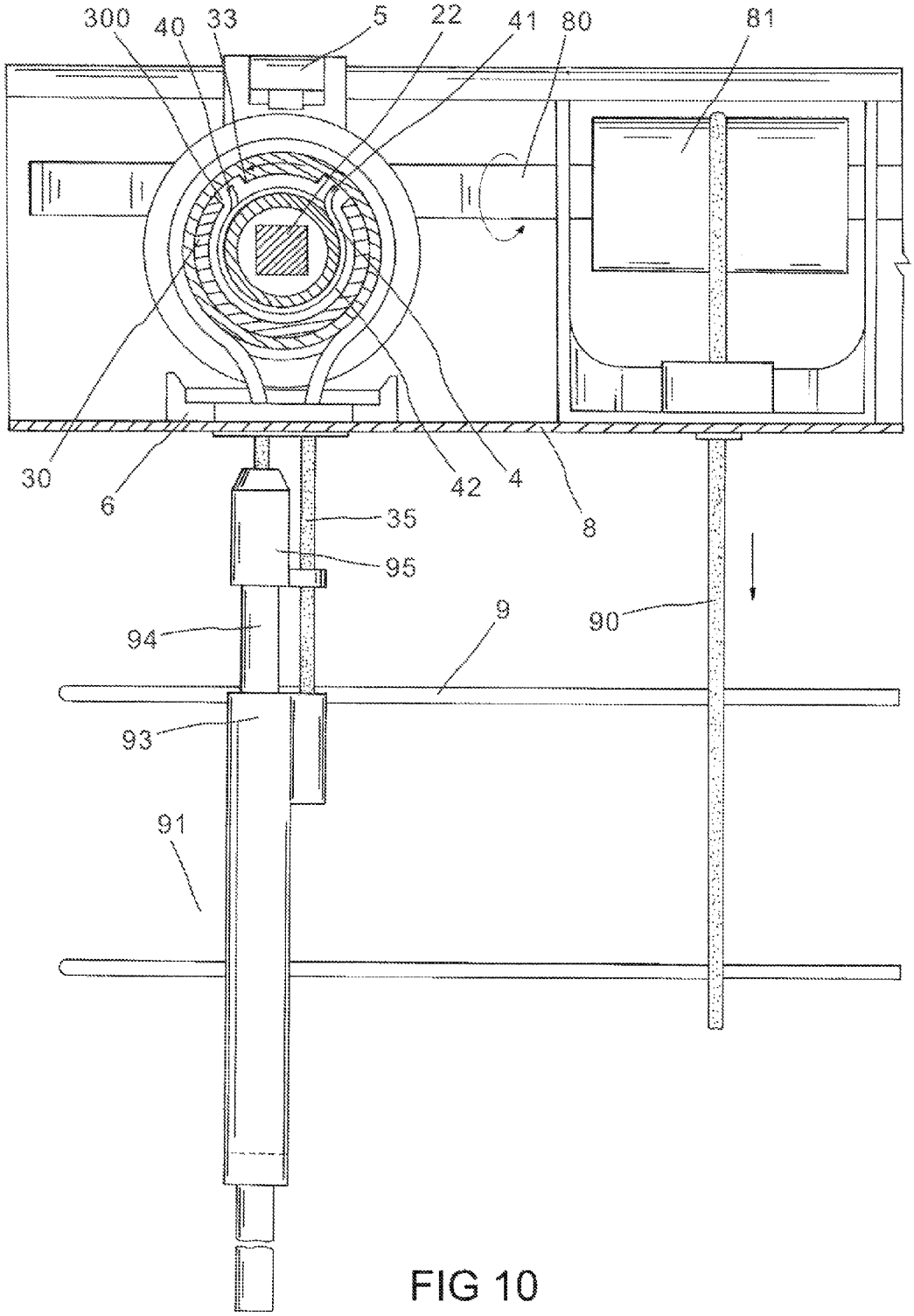
FIG. 10 is a view showing that the cord reel is braked to locate the blind slats.

Please refer to FIGS. 8 to 10. When locating the blind slats 9, the pull cord 35 is pulled downward by means of the movable sleeve 93 to make the cord reel 3 clockwise rotate. At this time, the push body 33 integrally protruding from the cord reel 3 is clockwise rotated along with the cord reel 3 to push the bent up stop section 41 of the coiled spring 4. Accordingly, the coiled spring 4, which originally binds the hub section of the base seat 1, is pushed and expanded to form a gap 42 between the coiled spring 4 and the hub section of the base seat 1. In this case, the cord reel 3 is released, whereby the rectangular rod section 22 can be driven and rotated. The coaxial thread 20 of the shaft rod 2 simultaneously drives the worm gear 7 to rotate. Via the rectangular slat control rod 80, the control drum 81 is rotated to control the rotational angle of the blind slats 9 (as shown in FIG. 8).

Please further refer to FIGS. 9 and 10. When the blind slats 9 are rotated to a predetermined light obstruction angle, a user stops pulling the cord reel 3. At this time, under a downward pull force caused by the blind slats' own weight, the push body 33 will be slightly displaced in a reverse direction to release the stop section 41 of the coiled spring 4. Under such circumstance, due to the push back force of the connection body 30 and the coiled spring's own elasticity, the coiled spring 4 is restored to its home position to again bind the hub section of the base seat 1. Accordingly, the cord reel 3 is braked and prevented from rotating so as to locate the blind slats 9 at the predetermined light obstruction angle. Therefore, the blind slats 9 can be located in their true positions without error in light obstruction angle.

The above embodiments are only used to illustrate the present invention, not intended to limit the scope thereof. Many modifications of the above embodiments can be made without departing from the spirit of the present invention.

What is claimed is:

1. A blind slat controller with braking function, comprising:

a base seat including a first casing and a second casing corresponding to the first casing, a semi-tubular protrusion being formed on one side of the first casing, another semi-tubular protrusion being formed on one side of the second casing complementary to the semi-tubular protrusion of the first casing, the first and second casings being mated and assembled with each other, whereby the semi-tubular protrusions of the first and second casings together form a cylindrical hub section with a central circular hole on one side of the base seat;

a coiled spring fitted around the hub section of the base seat, the coiled spring including multiple turns in adjacency to each other, two ends of the coiled spring being respectively formed with two bent up stop sections;

a cord reel having a closed face and an open end, a push body integrally protruding from inner circumference of the open end of the cord reel, a cord hole being formed on drum body of the cord reel in communication with the closed face, two ends of a pull cord being conducted through the cord hole and two perforations of a movable cover board to connect with a pull cord member;

a shaft rod having a circular rod section with a thread and a rectangular rod section, the circular rod section being rotatably received in the base seat, the rectangular rod section protruding out of the base seat to insert-connect with the cord reel; and a connection body, which is a cylindrical body with a notch, the connection body being received in the open end of the cord reel with the push body extending into the notch, a rectangular hole being formed on a bottom wall of the cylindrical body, the rectangular rod section of the shaft rod being fitted through the rectangular hole to connect with the connection body, the push body of the cord reel serving to push the stop sections of the coiled spring for twisting/untwisting the coiled spring so as to unbind or bind the hub section of the base seat, whereby the cord reel is permitted to rotate or is braked and prevented from rotating.

2. The blind slat controller with braking function as claimed in claim 1, wherein a cord retainer bar is disposed on the closed face of the cord reel.

3. The blind slat controller with braking function as claimed in claim 2, wherein the cord retainer bar has an oblique inner face.

4. The blind slat controller with braking function as claimed in claim 1, wherein the pull cord member connected with the ends of the pull cord includes a movable sleeve having a hollow interior, an elongated straight rod fitted through the hollow interior of the movable sleeve and a connection piece affixed to top end of the elongated straight rod and connected with one end of the pull cord.

5. The blind slat controller with braking function as claimed in claim 1, wherein two sides of the notch of the connection body are formed with push faces.

* * * * *